United States Patent [19]

LeCaire, Jr. et al.

[11] 4,191,307

[45] Mar. 4, 1980

[54] DISPENSER FOR PLASTIC BAGS

[75] Inventors: Robert A. LeCaire, Jr., Appleton; Barry B. Glashagel, Larsen, both of Wis.

[73] Assignee: Presto Products Incorporated, Appleton, Wis.

[21] Appl. No.: 889,709

[22] Filed: Mar. 24, 1980

[51] Int. Cl.[2] ..... B65D 85/672

[52] U.S. Cl. ..... 221/45; 206/409; 221/62; 242/55.53

[58] Field of Search ..... 221/45, 46, 61, 62, 221/63; 206/389, 390, 403–406, 408, 409; 242/55.53; 225/42, 43, 48, 49, 50

[56] References Cited

U.S. PATENT DOCUMENTS

| | | | |
|---|---|---|---|
| 1,713,857 | 5/1929 | Rapp | 225/42 |
| 1,827,000 | 10/1931 | Duffin | 225/43 |
| 2,475,657 | 7/1949 | Braley | 221/45 X |
| 3,415,407 | 12/1968 | Alden et al. | 206/403 X |
| 3,729,145 | 4/1973 | Koo et al. | 242/55.53 |
| 3,826,361 | 7/1974 | Heckrodt | 221/47 X |
| 3,893,609 | 7/1975 | Jamois et al. | 225/42 |

*Primary Examiner*—F. J. Bartuska

*Attorney, Agent, or Firm*—Wheeler, Morsell, House & Fuller

[57] ABSTRACT

Disclosed herein is a plastic wall-mounted dispenser primarily for coreless rolled sheet material and in which the plastic material, typically polypropylene, from which the dispenser is made is somewhat yieldable under stress. The dispenser is mounted in cantilevered relationship to the wall and the weight of the dispenser and its contents and pressures exerted thereagainst by the act of dispensing sheet material therefrom causes stresses which tend to twist the dispenser and open the latches by which the base and cover sections of the dispenser are latched together. To rigidify the structure, the base portion of the dispenser is formed in the shape of a hollow truncated pyramid which gives it an inherently strong beam configuration. The cover portion may also be formed in part in the shape of a hollow truncated pyramid. The latches comprise two snap latches proximate the corners formed by intersecting walls of the truncated pyramidal hollow base section so that these corners rigidify the latch assembly and reinforce the latches against distortion and release under stresses imposed upon the dispenser.

8 Claims, 6 Drawing Figures

TYPICAL DIMENSIONS FOR TWO DISPENSER SIZES ALL DIMENSIONS IN INCHES

OVERALL DISPENSER LENGTH 8.45
.40 ≤ A ≤ 1.8
2.0 ≤ B ≤ 4.6
.25 ≤ C ≤ 2.00

OVERALL DISPENSER LENGTH 10.70
.40 ≤ A ≤ 2.5
2.7 ≤ B ≤ 6.8
.25 ≤ C ≤ 2.3

DISPENSER FOR PLASTIC BAGS

BACKGROUND OF THE INVENTION

Sheet material dispensers made of plastic material and which in use rest upon an underlying surface are known. The dispenser of the present invention, however, is intended to be mounted on an upright wall and in cantilevered relation thereto. This imposes considerable stress on the plastic walls of the dispenser, particularly when the dispenser is carrying the weight of its contents and the contents are dispensed through a dispensing slot, thus subjecting the dispenser to twisting forces which tend to distort the dispenser and impose stress upon the latches which hold hollow base and cover portions of the dispenser together. The stress imposed upon the dispenser by dispensing sheet material is particularly acute when the sheet material comprises a relatively non-yieldable and non-tearable material such as plastic film used in plastic bags, such as trash bags, garbage bags, food containing bags, etc. Such stress is further increased if the sheet material is pulled out of the dispenser with a sideways motion, thus tending to twist the dispenser.

SUMMARY OF THE INVENTION

In accordance with the present invention, such a dispenser adapted for cantilevered mounting on a wall has a hollow base mounting portion formed in the shape of a truncated pyramid, to give it an inherently strong beam configuration. The side walls of the base portion intersect the angled corners and the latches by which the base portion is releasably interconnected to a swingable hollow main body or cover portion are proximate these corners. Accordingly, the corners reinforce and rigidify the latches so that the latches will not open inadvertently even when the dispenser is subjected to considerable stress.

The side walls of the cover portion are also desirably formed in the shape of a truncated pyramid to give it an inherently strong beam configuration. In the disclosed embodiment, the cover portion is formed in the shape of a bent truncated pyramid to provide bends or breaks in the side walls to further rigidify these walls.

Other objects, features and advantages of the invention will appear from the disclosure hereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
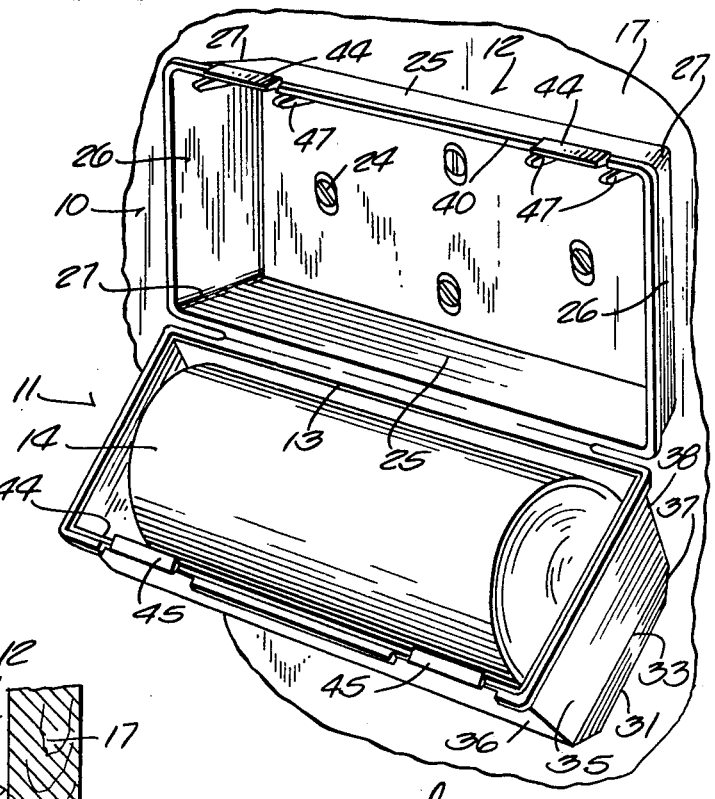
FIG. 2 is a perspective view of the dispenser with the front cover portion swung downwardly to an open position in which it acts as a tray.

The dispenser 10 comprises two hollow portions or sections, a cover or main body section 11 and a base or mounting section 12. The two sections 11, 12 are pivotally connected one to the other on a hinge 13. The two sections 11, 12 are both fabricated of plastic material which desirably comprises polypropylene. This plastic material is inherently resilient and somewhat yieldable and deformable under pressure. Hinge 13 is made of the same material as the walls of the hollow sections 11, 12 and permits the sections to swing, as shown in FIG. 2.

Figure 1:
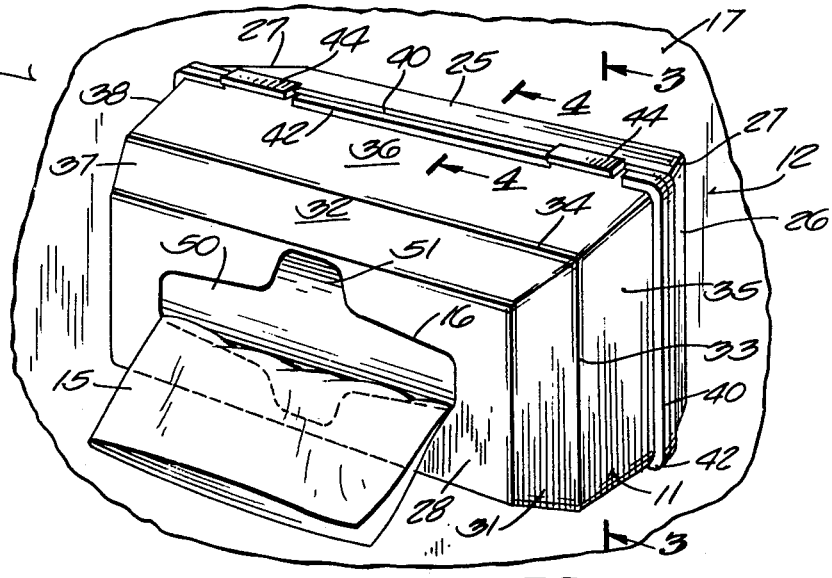
FIG. 1 is a perspective view of a wall-mounted dispenser embodying the present invention.

Although the dispenser will dispense many types of sheet material, it is primarily intended to dispense sheet material arranged in a coreless roll as disclosed in U.S. Pat. No. 3,826,361 issued July 30, 1974. This sheet material comprises a series of discrete plastic film bags which are folded a number of times and then are overlapped in shingled relation and then rolled into a coreless roll 14. In use, the leading end 15 of the outermost plastic bag of roll 14 will project through a dispensing slot 16 in the cover section 11 of the dispenser, as shown in FIG. 1 herein. The act of dispensing one bag will draw the leading end of the next succeeding bag in the roll 14 to the position shown in FIG. 1 in readiness for the next dispensing operation.

An important feature of the invention relates to the shape of the hollow dispenser cover and base sections 11, 12. Unlike dispensers which simply rest upon an underlying support surface, the dispenser of the present invention is intended to be mounted in cantilevered relationship to an upright wall 17. Accordingly, the weight of the dispenser and its contents must be supported by the base section 12 which must be strong enough to resist the leverage applied thereto by the weight of the cover section 11 and the weight of the roll 14 of sheet material carried thereby. Moreover, the cover and base sections 11, 12 are subjected to considerable additional stress because the person pulling on the end 15 of the sheet material may not pull directly outwardly from the dispensing slot 16, but may pull sideways, thus to introduce racking or twisting stresses on the dispenser. Because of its inherently resilient and yieldable characteristics, the walls of the dispenser will tend to twist and distort and release the latches 18 by which the cover section 11 is latched to the base section 12.

In accordance with the present invention, the base section 12 is given an inherently strong beam configuration by making it in the shape of a truncated pyramid. The base secton 12 comprises a relatively thick base panel 21 by which the dispenser is mounted on wall 17 through fastening means, such as the screws 22. Base panel 21 is provided with countersunk recesses 23 to recess therein the heads 24 of the screws 22.

Side walls of the base section 12 comprise side panels 25 and end panels 16 which intersect at angled corners 27. The side panels 25 and end panels 26 are disposed at obtuse angles to the back panel 21 in order to produce the truncated pyramidal shape of dispenser sections 12.

Cover section 11 which comprises the main body portion is also desirably in the shape of a truncated pyramid. In the disclosed embodiment, the shape is that of a bent truncated pyramid. The top of the pyramid comprises a front dispenser panel 28 in which the dispensing slot 16 is disposed. The sides and ends of the bent truncated pyramid cover section 11 comprise end panals 31, 35 intersecting at bend or corner 33 and side panels 32, 36 intersecting at bend or corner 34. The end and side panels 32, 35 are disposed at oblique angles to the front dispenser slot panel 28. The bends 33, 34 between the panels 31, 35 and 32,36 function as breaks, bends or ridges to give the cover section 11 an inherently strong beam configuration. The end panels 31, 35 also intersect the side panels 32, 36 at corners 37, 38 in an inherently strong configuration.

Figure 4:
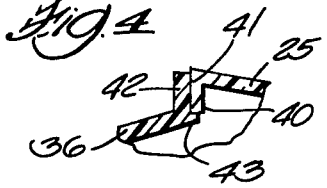
FIG. 4 is a fragmentary cross section taken along the line 4—4 of FIG. 1.
Figure 3:
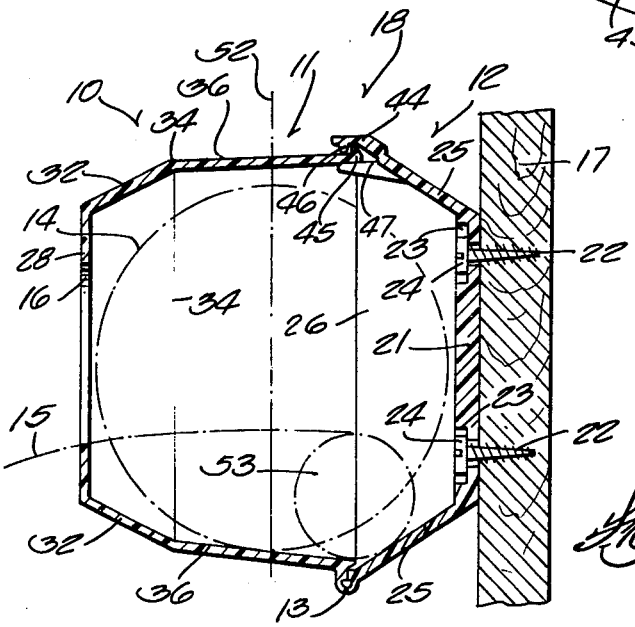
FIG. 3 is a vertical cross section taken through a mounted dispenser embodying the invention.

When the cover section 11 is closed against the base section 12, as illustrated in FIGS. 1 and 3, the edges of the side panels 25 and edge panels 26 on the base section 12 mate with the edges of the side panels 36 and the end panels 35 of the cover section 11. As best shown in FIG. 4, the respective edges of the mating panels are shaped to provide an interlock and a good seal between the mating parts. The outermost edges of panels 25, 26 of base section 12 are formed as shown in FIG. 4 with a lip 40 received within a groove 41 formed in the outer edges of the panels 35, 36 of the cover section 11. Groove 41 is formed by the intersection of lip 42 and lip 43 provided on the outermost edges of said panels 35, 36, as best shown in FIG. 4. Accordingly, when the dispenser is closed, the interengagement of lip 40 with the groove 41 registers the base and cover sections together and provides lateral stability to the over-all structure.

Figure 5:
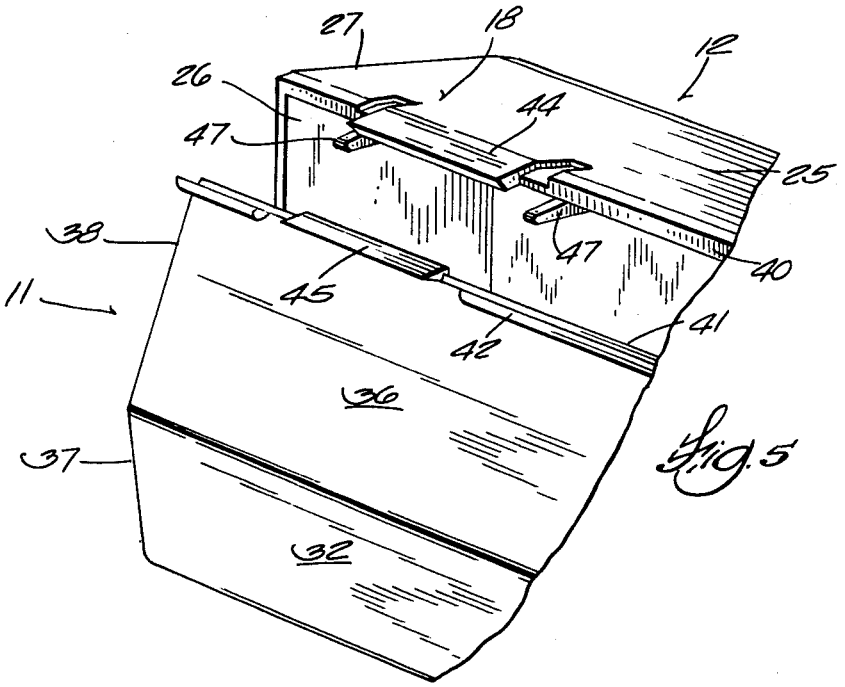
FIG. 5 is a fragmentary perspective view of a partially open dispenser and illustrating the relationship between latch elements on the base and cover portions of the dispenser.

As best shown in FIG. 5, the tongue and groove interlock between the mating edges of the panels of the cover section 11 and base section 12 of the dispenser are interrupted on the side of the dispenser opposite the hinge 13 where latch means 18 are provided. It has been found that a single latch near the center of the longitudinal extent of the dispenser is not adequate to hold the dispenser sections together during use and during the stresses that are imposed thereupon. This is because the center of the longitudinal extent of the dispenser sections is subject to the yieldability of the plastic material of the wall panels and will be deformed out of interlocking connection under such stresses. Accordingly, an important part of the present invention is to dispose the latch assemblies 18 proximate the corners 27 of the base section 12. These corners are made quite rigid because of the angle of intersection of the end panels 26 with the side panels 25.

The latches 18 comprise snap couplings or latches which will engage when the plastic material thereof will be deformed under closing pressure and which will release under opening pressure because of the yieldability of the plastic material. However, considerable force must be applied both to latch and unlatch the latches 18 and the pressure necessary for latching and unlatching exceeds the forces exerted upon the latches during normal use of the dispenser, even when the plastic bags 15 are pulled sideways in the course of dispensing them through slot 16.

The latch means or assembly 18 comprises an overhanging jaw 44 near both ends of panel 25 and proximate the corners 27. Jaw 44 is provided with an elongated tooth 46. The edge of panel 36 of cover section 11 has a corresponding elongated tooth 45. In the course of closing the dispenser, tooth 46 will ratchet or ride over the tooth 45 and then snap back to interlock in overlapped relation, as shown in FIG. 3.

Panel 25 also has a pair of jaw tangs 47 which engage the opposite side of panel 36 from tooth 45, thus to hold the toothed edge of the panel 36 securely between the jaws formed by jaw 44 and tangs 47 on the panel 25 of the base section 12. When the dispenser is opened for refilling purposes, sufficient pressure has to be applied to cause jaws 44, 47 to yield apart as the tooth 45 on panel 36 exerts outward pressure on the tooth 46 of the jaw 44.

The latch means or assembly 18 is desirably close enough to the corners 27 of the base section 12 to provide a stable base support from wall-mounted panel 21 for the latch assembly 18 so that the normal stresses and pressures exerted while the dispenser is in use will not distort the latch parts and cause unwanted opening of the dispenser. At the same time, the latch means or assembly 18 should be far enough from the corner 27 so that enough yieldability in the intervening dispenser wall is retained to enable the user to conveniently open the latch. The precise location of the latches involves a compromise between the requirements for utilizing the yieldability of the wall material to permit release of the latch when wanted, but to stabilize the latch sufficiently to prevent unwanted opening of the latch during use of the dispenser. The precise location of the latches will depend to some extent upon the size of the dispenser which, in turn, is dictated by the size of the bags to be dispensed therein. The coreless bag roll 14 varies in axial length, depending upon bag size. Accordingly, although there may be some variation in the precise locations of the snap latches 18, depending upon the over-all size of the dispenser, it is generally true that they are rather widely spaced one from the other and are proximate but somewhat spaced from the corners 27.

Another factor enhancing dispenser rigidity in the vicinity of the latch means 18 is the stiffening effect of the longitudinal bends or breaks 34 in the cover section 11. These bends 34 reinforce the wall panel 36 upon which latch tooth 45 is mounted.

Still another factor enhancing dispenser rigidity in the vicinity of the latch means 18 is the asymmetric relation of the latch means 18 with respect to the front panel 28 and rear panel 21 of the dispenser. The centerline of the dispenser with respect to the front panel 28 and rear panel 21 is indicated in FIG. 3 at 52. Latch means 18, hinge 13 and the mating edges of the cover section 11 and base section 12 are disposed in a plane offset toward the base panel 21 from centerline 52. Accordingly, the latch means 18 is on a shorter moment arm from the base panel 21 than it would be if it were closer to the centerline 52. This helps the latches resist unwanted opening pressure caused by stresses imposed on the cantilevered dispenser, especially those caused by the user pulling the bags out of the dispenser slot with a sideways component of pressure.

The dispenser slot 16 is desirably formed in the shape of a cross. Its longitudinal slot 50 is not quite as long as the front face 28 of the dispenser so that the bag end 15 can be threaded therethrough even though the bag has to be pinched longitudinally in order to fit through the slot 50. In the course of initial threading of the sheet material through dispensing opening 16 or to facilitate the user's access to the leading edge of a bag which is still within the dispenser, lateral slot 51 of dispensing opening 16 is provided. Both slots 50, 51 provide good thumb and finger access to the interior of the dispenser when the user's hand is oriented either horizontally or vertically with respect thereto.

As best shown in FIGS. 2 and 3, when the roll 14 is initially placed within the dispenser, it will occupy almost the entire space therewithin. Inasmuch as the roll 14 is circular in cross section, it will fit particularly compactly within the dispenser because of the angled wall panels 25, 32 thereof. Full roll 14 will rest on the bottom panel 36 of the cover section 11 of the dispenser as shown in FIG. 3. Cover section 11 is made relatively deep and base section 12 is made relatively shallow so that the hinge 13 and latches 18 are closer to base panel 21 than to cover panel 28. This relationship offsets both the hinge 13 and the latches 18 away from the maximum diameter of a full roll 14 and locates the tangs 47 of the latches 18 out of range of a full roll 14. Accordingly, the possibility of the roll snagging on the tangs is reduced to a minimum by this offset location of the tangs.

The end 15 of the sheet material of the roll 14 may lead off of the top of the roll or off of its bottom, this being generally immaterial to the manner in which the dispenser is used. In FIG. 3, the end 15 is shown coming off the top of a mostly depleted roll 53. Note that for such a depleted roll 53, the side wall panel 25 of base section 12, which is lowermost in this figure, acts as a ramp or incline down which the partially depleted roll 53 will roll to keep the outermost layer of sheet material on the roll from contact with the back panel 21 and any protruding portions of the screw heads 24 which might otherwise tend to snag the outer surface of the roll 53.

When mounted, the hinge 13 is desirably placed at the bottom of the dispenser and the latches 18 at the top. Accordingly, when the cover section 11 is opened, as shown in FIG. 2, the cover section 11 will function as a tray in which the roll 14 may easily be placed so as to avoid inadvertent dropping of the roll 14 on the floor.

Figure 6:
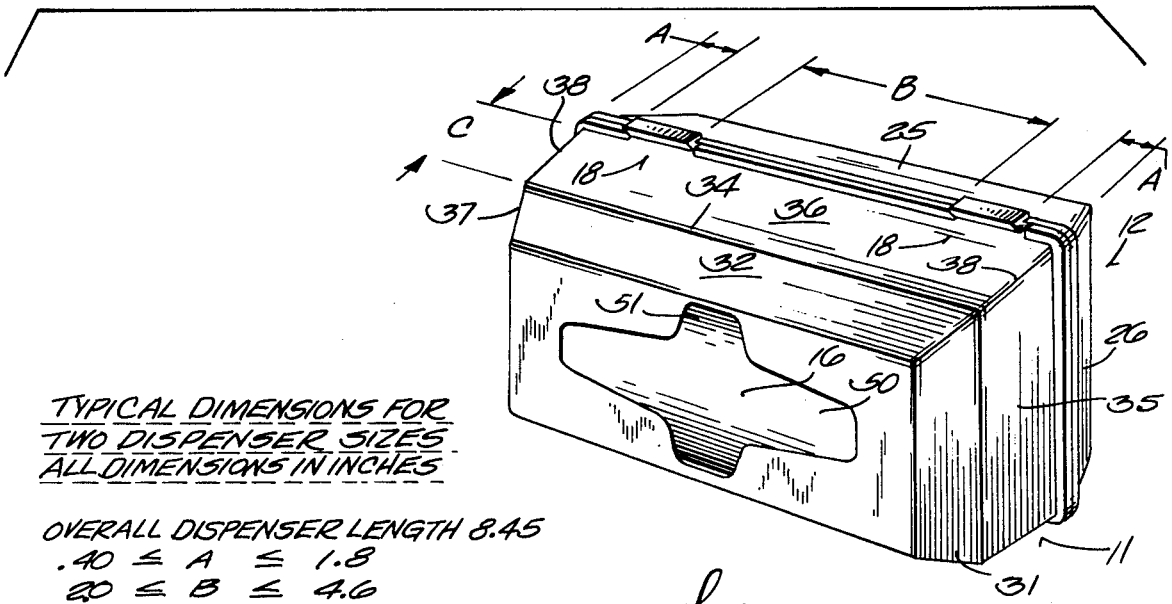
FIG. 6 is a perspective view of a dispenser embodying the invention and a table of dimensions related thereto.

FIG. 6 and the table adjacent thereto illustrates certain dimensional relationships which have been found to be desirable in certain typical dispensers embodying the invention. The ranges indicated in the table will yield good results and the ranges can be extended for less desirable results. Other dispensers, larger and smaller than those mentioned in the table may, have somewhat different ranges, depending upon circumstances.

What is claimed is:

1. A sheet material dispenser adapted to be mounted on an upright wall and having a mounting base section and a cover section, a hinge interconnecting said sections so that the cover section may be swung away from the base section to load sheet material thereinto, latch means for latching the two sections together when the cover section is swung closed, said cover section being supported by the base section in cantilevered relation to said upright wall to impose the weight of the loaded dispenser and pressures developed by dispensing sheet material from the dispenser on the base section, said sections comprising plastic material which is yieldable under stress, said base section having a flat base panel adapted to be fastened to the upright wall and side and end panels extending at obtuse angles from the base panel and intersecting one another to form angled corners and to constitute the base section as a truncated pyramid enclosing a hollow space and having inherently strong beam configurations to withstand the pressures exerted thereon without sufficient change of shape to release the latch means when the dispenser is mounted, loaded and is use, said side panels having edges spaced from the base panel, said hinge being disposed on the edge of one side panel and the latch means being disposed on the edge of the other side panel whereby to space the hinge and latch means from said upright wall, said latch means comprising two snap latches proximate the corners formed by the intersecting side and end panels of the base section.

2. The dispenser of claim 1 in which the sheet material comprises a coreless roll, the bottom panel of the base section of a mounted dispenser constituting an inclined ramp urging a diminished roll forwardly away from contact with the flat base panel.

3. The dispenser of claim 1 in which the cover section is in the shape of a truncated bent pyramid.

4. The dispenser of claim 1 in which said cover section has a flat panel with a dispensing slot formed therein and has side and end panels extending at obtuse angles from the base panel and intersecting one another to form angled corners.

5. The dispenser of claim 4 in which the side panels of the cover section have longitudinal angle bends to stiffen the cover section.

6. A sheet material dispenser adapted to be mounted on an upright wall and having a mounting base section and a cover section, a hinge interconnecting said sections so that the cover section may be swung away from the base section to load sheet material thereinto, latch means for latching the two sections together when the cover section is swung closed, said cover section being supported by the base section in cantilevered relation to said upright wall to impose the weight of the loaded dispenser and pressures developed by dispensing sheet material from the dispenser on the base section, said sections comprising plastic material which is yieldable under stress, said base section having a flat base panel adapted to be fastened to the upright wall and side and end panels extending at obtuse angles from the base panel and intersecting one another to form angled corners and to constitute the base section as a truncated pyramid enclosing a hollow space and having inherently strong beam configurations to withstand the pressures exerted thereon without sufficient change of shape to release the latch means when the dispenser is mounted, loaded and in use, the hinge being disposed at one side of the dispenser and the latch means comprising two snap latches located at the other side of the dispenser and proximate the corners formed by the intersecting side and end panels of the base section, the hinge being disposed at the bottom of the wall-mounted dispenser and the latches being disposed at the top of the wall-mounted dispenser whereby the cover section will swing downwardly about the hinge to form a tray to receive and support sheet material in the course of loading the dispenser.

7. The dispenser of claim 6 in which said snap latches comprise jaw means formed on the edge of a side panel of the base section which is uppermost when the dispenser is wall mounted, said cover section having a panel with an edge having a tooth embraced by said jaw means when the dispenser is closed.

8. A sheet material dispenser adapted to be mounted on an upright wall and having a mounting base section and a cover section, a hinge interconnecting said sections so that the cover section may be swung away from the base section to load sheet material thereinto, latch means for latching the two sections together when the cover section is swung closed, said cover section being supported by the base section in cantilevered relation to said upright wall to impose the weight of the loaded dispenser and pressures developed by dispensing sheet material from the dispenser on the base section, said sections comprising plastic material which is yieldable under stress, said base section having a flat base panel adapted to be fastened to the upright wall and side and end panels extending at obtuse angles from the base panel and intersecting one another to form angled corners and to constitute the base section as a truncated pyramid enclosing a hollow space and having inherently strong beam configurations to withstand the pressures exerted thereon without sufficient change of shape to release the latch means when the dispenser is mounted, loaded and in use, said cover section comprising a front panel having a dispensing slot and side and end panels extending from the base panel to enclose a hollow space therebetween, the hollow space within the cover section being larger than the hollow space within the base section and the hinge and latches being disposed asymmetrically to the respective base panels of the said base section and cover section and closer to the base panel of the base section than to the front panel of the cover section, said latch means comprising jaw means including tangs on the inside edge of the side panel of the base section which is uppermost when the dispenser is mounted and out of contact with a full roll of sheet material by reason of the asymmetric location of the latches.

* * * * *